United States Patent [19]

De Pinna

[11] 4,054,001

[45] Oct. 18, 1977

[54] THREE DIMENSIONAL HANGING DISPLAY DEVICE

[75] Inventor: George De Pinna, Forest Hills, N.Y.

[73] Assignee: Goodren Products Corporation, N.J.

[21] Appl. No.: 716,388

[22] Filed: Aug. 23, 1976

[51] Int. Cl.[2] ..... G09F 19/00

[52] U.S. Cl. ..... 40/126 A; 40/124.1

[58] Field of Search ..... 40/125 R, 125 L, 124.1, 40/10, 126 A, 128

[56] References Cited

U.S. PATENT DOCUMENTS

| | | | |
|---|---|---|---|
| 1,202,106 | 10/1916 | Schmidt | 40/124.1 X |
| 1,592,196 | 7/1926 | Ganz | 40/124.1 X |
| 2,080,733 | 5/1937 | Mull | 40/125 A X |
| 2,081,095 | 5/1937 | Mull | 40/125 L X |
| 2,255,535 | 9/1941 | Sauer | 40/124.1 X |
| 2,401,615 | 6/1946 | Chittum | 40/124.1 X |
| 2,984,031 | 5/1961 | Giesecke | 40/124.1 X |
| 3,234,676 | 2/1966 | Colicki | 40/126 A X |
| 3,423,860 | 1/1969 | Berry et al. | 40/125 R X |
| 3,774,328 | 11/1973 | Tanney | 40/128 X |
| 3,971,149 | 7/1976 | Tanney | 40/124.1 X |

*Primary Examiner*—Louis G. Mancene
*Assistant Examiner*—Wenceslao J. Contreras
*Attorney, Agent, or Firm*—Brumbaugh, Graves, Donohue & Raymond

[57] ABSTRACT

A display device for advertising or other purposes has a generally vertical support portion fastened to a wall or shelf railing, a dangling portion with a three-dimensional configuration, and an elongated strip-shaped portion extending from the bottom of the support portion to the dangling portion in an arc-shaped configuration. The display device is formed from a unitary sheet of resilient material by appropriate folds and the sealing together of particular portions of the device with adhesive strips located on the sheet. The device is particularly useful for advertising representations of squeeze tubes, such as those used for toothpaste or hair cream.

5 Claims, 5 Drawing Figures

THREE DIMENSIONAL HANGING DISPLAY DEVICE

BACKGROUND OF THE INVENTION

This invention relates to a display device and, more particularly, to a display device in which flat sheet material is adapted to present a three-dimensional dangling advertisement.

In U.S. Pat. No. 3,774,328, which is assigned to the assignee of the present application, a dangling display device formed from a unitary sheet of resilient material is illustrated. This device has a flat display portion which is attached to the bottom of a support portion by means of an elongated strip-shaped spine. Because of a sharp crease at the connection of the spine to the support, the spine has an arc-shaped configuration. Dangling devices of this type represent a particularly attractive and useful advertising implement because of the motion of the display portion when vibrations or breezes occur in their vicinity.

Three-dimensional displays with a curved or polyhedral shape are known from the prior art. In particular, curved three-dimensional diplays are described in U.S. Pat. No. 2,255,535 to L. Sauer and U.S. Pat. No. 3,234,676 to F. J. Colicki et al. Rectangular and triangular advertising displays are illustrated in U.S. Pat. No. 1,202,108 to W. A. Schmidt and U.S. Pat. No. 1,592,196 to A. J. Ganz, respectively. However, efforts to create a cylindrical element, such as a can, from a flat, flexible sheet were unsuccessful until the advent of the invention described in U.S. Pat. No. 3,971,149 assigned to the assignee of the present invention. The device of that patent, which can be formed into a more cylindrical and stable shape, has an adhesive strip along the front of the flat sheet adjacent the fold line that separates the support from the portion of the sheet that will form the cylinder. The adhesive is used to secure adjacent front portions of the sheet face-to-face when the sheet is creased along the fold line. The cylinder is then formed by rolling the display portion of the sheet in the "reverse" direction, i.e. away from the direction of the crease so that the front of the sheet becomes the outside surface of the cylinder. An adhesive strip along the far edge of the rolled portion of the sheet is used to complete the cylinder by securing that edge adjacent the fold line.

SUMMARY OF THE INVENTION

The present invention is directed to a means for providing a combined dangling and three-dimensional display from a unitary flat resilient sheet with printing on one side only, particularly a dangling three-dimensional display of a partially flattened squeeze tube, such as those used for toothpaste.

In an illustrative embodiment of the invention a unitary sheet of resilient material is generally divided into upper and lower sections by a fold line. To aid in the manufacture of the device all of the advertising is printed on one side of the unitary sheet. The lower section of the sheet is folded upward along the fold line and is secured to the upper section by an adhesive strip located on the upper section adjacent the fold line. The free end of the bottom section is then folded downward, so as to form a cylinder from which the squeeze-tube shape is made. This end is then secured to the back of the lower section near the fold line by means of an adhesive strip located on the front of the lower section near its bottom. Accurate formation of the cylinder is brought about my means of centering marks at the top and bottom of the lower section. Two large tabs are located at both ends of the bottom of the lower section. The tab at the end of the cylinder that has been printed to look like the top of the tube is bent back behind the upper section and is attached to it by means of an adhesive strip. In order to complete the squeeze-tube shape the end of the cylinder which has been printed to look like the bottom of the tube is flattened and creased for some distance from the end and a small extension located at this end is sharply folded onto the back of the upper section. The tab at the bottom end of the tube is positioned behind the upper section by means of the fold of the small extension and it is secured in place by an adhesive strip.

The upper section of the unitary sheet has a relatively wide support portion near its top which is connected to a flat display or dangle portion near its bottom by means of a relatively narrow elongated spine portion. The three-dimensional squeeze tube created from the lower section is therefore attached to the dangle since the squeeze tube was constructed in conjunction with the bottom part of the upper section. As a result a three-dimensional dangle has been created from a unitary sheet.

The support is sharply folded downward at its connection to the spine and is secured to a wall or a shelf railing so that the spine extends from the bottom of the support.

BRIEF DESCRIPTION OF THE DRAWINGS

The foregoing and other features of the present invention will be more readily apparent from the following detailed description and drawings of an illustrative embodiment of the invention in which.

DESCRIPTION OF THE PREFERRED EMBODIMENT

Figure 1:
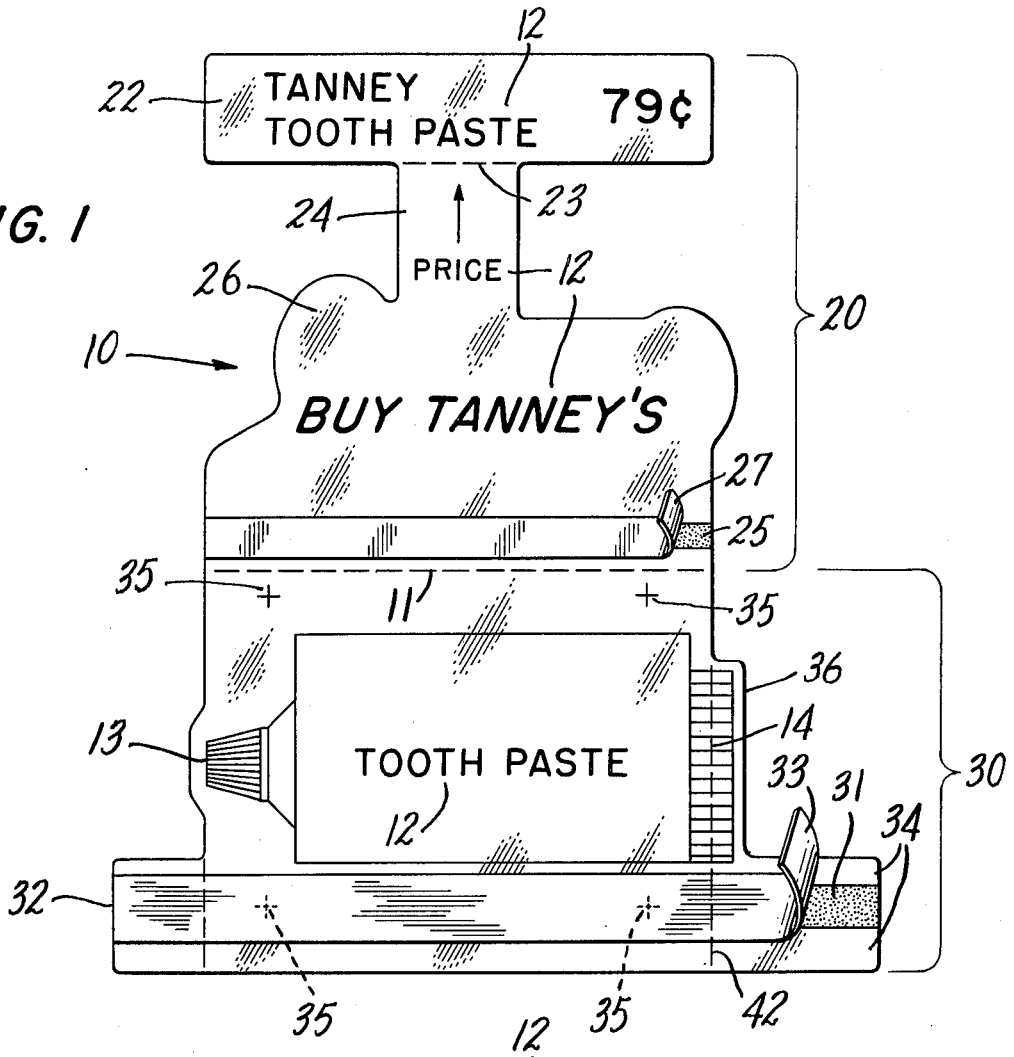
FIG. 1 is an illustration of a unitary resilient sheet adapted to be formed into a display arrangement in accordance with the present invention.

In FIG. 1 there is shown a unitary sheet 10 of resilient material. The material can be any of a variety of opague or transparent materials including plastic or paper. Advertising copy 12 can be printed anywhere on the front of the sheet if it is opaque. If the sheet is transparent, the copy can be printed anywhere on the front or back of the sheet in such a manner that it can be viewed from the front. In either case it is an advantage of the present display device that the copy only needs to be printed on one side.

A dividing fold line 11 divides the sheet into an upper section 20 and a lower section 30. The upper section 20 has a relatively wide support portion 22 that is connected to a display or dangle portion 26 by means of a relatively narrow elongated spine portion 24. A fold line 23 divides the support 22 from the spine 24. A pressure sensitive adhesive strip 25 covered by a paper release strip 27 is located along the bottom of the dangle portion adjacent the fold line 11.

The lower section 30 of the unitary sheet has a generally rectangular shape with two tabs, 32 and 34, extending from either end near the bottom of the section. The advertising copy printed on the lower section has the outline of a partially flattened squeeze tube with its top 13 located to the left in FIG. 1 and its bottom 14 to the right. An extension 36 is located at the right of the lower section and part of the printing for the bottom of the squeeze tube is located on it. A fold line 42 separates the extension from the rest of the lower portion. A pressure sensitive adhesive strip 31 with its associated paper release strip 33 is located near the bottom of the lower section and extends onto both of the tabs. Centering marks 35 are located at the four corners of the lower section.

Figure 2:
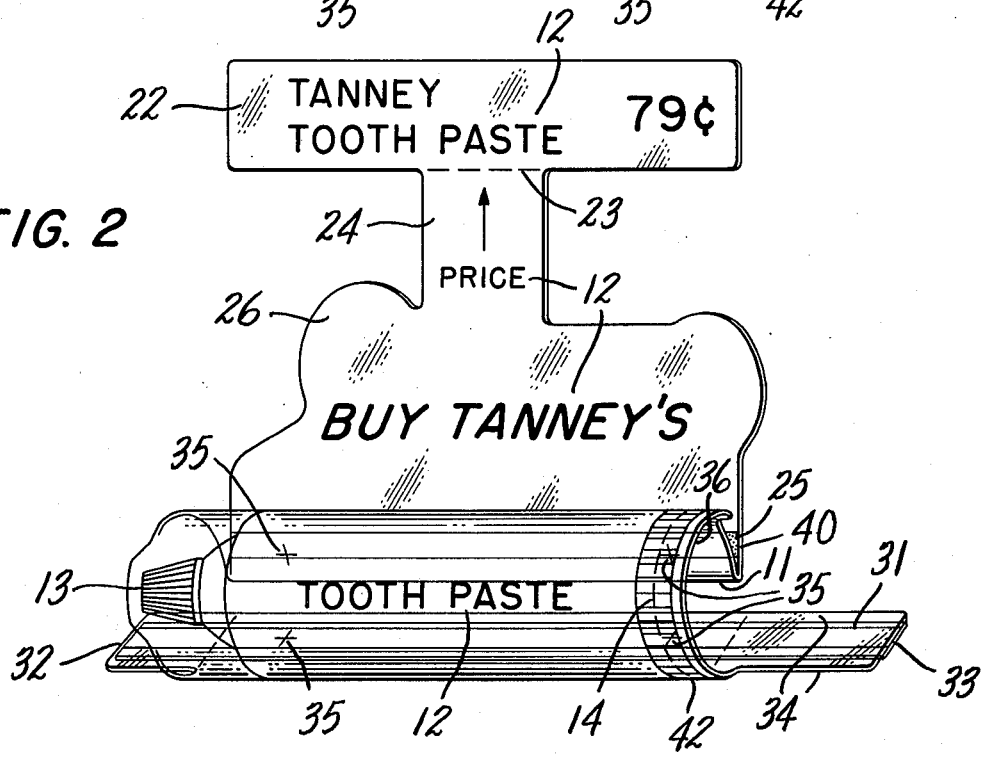
FIG. 2 is a perspective view that illustrates the manner of folding the lower portion of the display device to from a cylinder according to the present invention.

In forming the display device from the unitary sheet, the lower section is folded up against the upper section along fold line 11 and a firm crease is made as is shown if FIG. 2. The release strip 27 is removed and the front surfaces of the upper and lower sections (20 and 30) are sealed together in a face-to-face configuration in the region of the adhesive 25. This seal is indicated at 40 in FIG. 2. Then the bottom of free end of the lower section is rolled forward to form a cylinder. Strip 33 is removed from adhesive 31 and the bottom of the lower section is sealed to the back of the lower section. In order to aid in making the connection the centering marks 35 at either end of the cylinder are superimposed over each other. It should be noted that if the sheet is transparent, the centering marks at the top of the lower section appear through the back of the lower section adjacent the bottom of the upper section once the two sections have been sealed together in face-to-face relationship by adhesive 25. Therefore, a target for the centering marks at the bottom of the lower section is provided at the bottom of the upper section.

Figure 3:
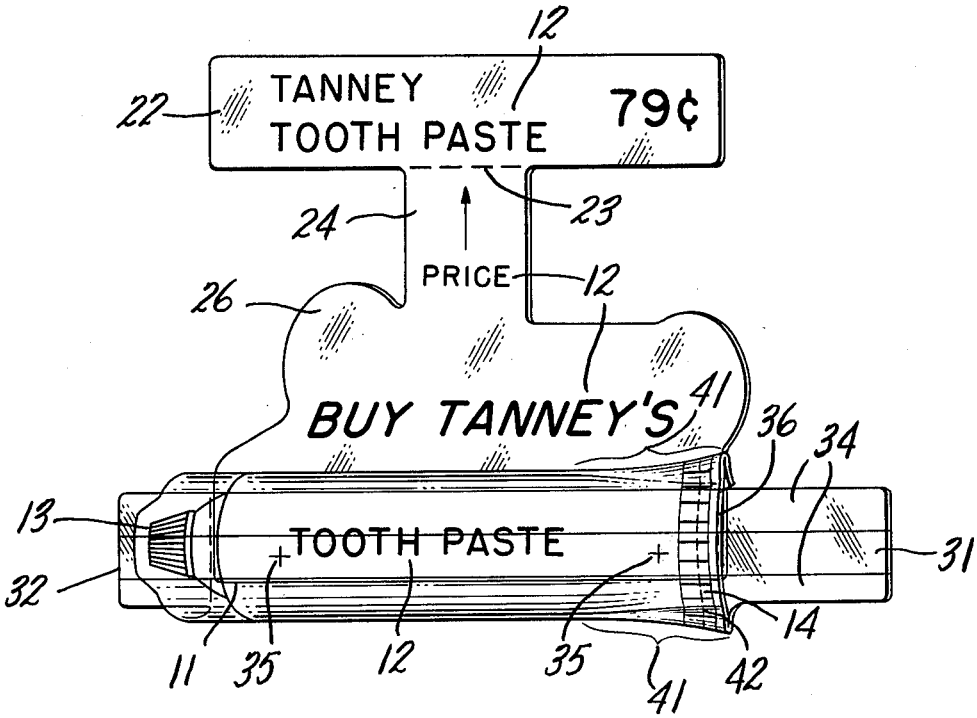
FIG. 3 is a perspective view that illustrates the manner of folding the lower portion of the display device to form a tube according to the present invention.

Once the cylinder has been formed the tab 32 shown in FIG. 3 is folded onto the back of the upper section. Since the adhesive strip 31 extends onto the tab 32 the tab will be sealed to the back of the upper section. At the opposite end the cylinder is pinched to form a flat tube end, and the top and bottom edges of the tube end are firmly creased for a distance 41 equal to about 20% of the tube length. Extension 36 is then folded onto the back of the upper section along score line 42. The process of folding the extension 36 also causes the tab 34 to be folded onto the back of the upper section, where it is held in place by adhesive strip 31, thus completing the formation of the squeeze tube on the dangle portion of the device.

Figure 4:
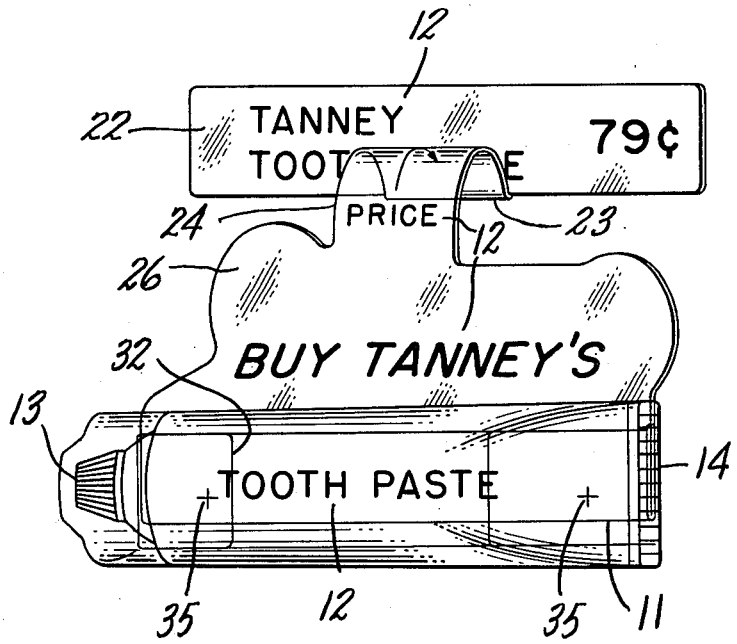
FIG. 4 is a perspective view of a completed display arrangement in accordance with the present invention.
Figure 5:
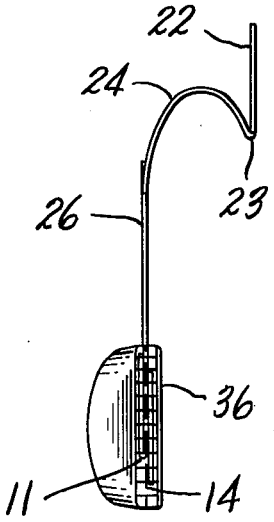
FIG. 5 is an end view of the display device of FIG. 4 showing the location of the folded tabs at the end of the tube and the dangle fold.

As shown in FIGS. 4 and 5, the support portion of the upper section is bent into a face-to-face position with respect to the spine portion along fold line 23. Then the support portion is secured to a wall, e.g. with an adhesive, or is located in a shelf railing in such a way the spine portion extends in an arc-like fashion from the bottom of the support portion.

While the invention has been particularly shown and descirbed with reference to a preferred embodiment thereof, it will be understood by those skilled in the art that various changes in form and details may be made therein without departing from the spirit and scope of the invention. In particular, three-dimensional dangle-type displays with shapes other than a squeeze tube could be formed from a unitary resilient sheet of material.

I claim:

1. A display device for arrangement into a three-dimensional configuration, comprising:

a unitary, thin, flexible sheet having a front information display surface and a back surface, the sheet having a first section and a second section with a dividing line therebetween, said first section having a dangle portion adjacent said dividing line which is connected to a support portion remote from said dangle portion by an elongated spine portion, said spine portion is relatively narrow compared to said support portion, said second section having at least one tab extending from each of its edges that are perpendicular to the dividing line, said tabs being located adjacent the edge that is parallel to and remote from the dividing line;

first adhesive means located on the front of said dangle portion in a strip that is parallel to and adjacent the dividing line; and second adhesive means located on the front of said second section in a strip that is parallel to the dividing line and extends between the tabs, whereby upon arrangement of said device in its three-dimensional configuration, said first adhesive means secures together the front surfaces of the first and second sections adjacent a crease along the dividing line, said second adhesive means secures the front surface of the second section remote from the dividing line to the back of the second section adjacent the dividing line and also secures the front of the tabs onto the back of the botton of the first section in order to form a three-dimensional shape that is mounted on the front of the dangle portion, said support portion being sharply bent toward said spine portion at its intersection with the spine portion so that when the device is in its display position, the spine portion arches away from the bottom of the support portion and suspends the dangle portion containing the three-dimensional shape.

2. A display device as claimed in claim 1 wherein said first section is transparent in the region adjacent the dividing line and further including centering marks on the second section adjacent the dividing line and adjacent the edge remote from the dividing line, whereby the accurate formation of the three-dimensional shape is assisted by superimposing on one another the marks adjacent the dividing line and the marks remote from the dividing line.

3. A display device as claimed in claim 1 wherein said first and second adhesive means comprise release strip covered pressure sensitive adhesives.

4. A display device as claimed in claim 1 wherein the three-dimensional shape is that of a squeeze tube arranged on the dangle portion generally parallel to the dividing line.

5. A display device as claimed in claim 4 further including a printed representation of the squeeze tube with its top at one edge of said second section and its bottom at the other edge, and an extension to the edge of the second section on which the bottom of the tube is printed, the three-dimensional shape formed by securing the front of the bottom of the second section to the back of the top of the second section being flattened at the tube end by means of creases extending from the tube end a substantial distance along the sides of the three-dimensional shape generally parallel to the dividing line, and a crease along the intersection of the extension with the rest of the second section so that the back of the extension is bent onto back of said first section.

* * * * *